United States Patent [19]

Narvaez

[11] Patent Number: 4,937,965

[45] Date of Patent: Jul. 3, 1990

[54] ADJUSTABLE GUN REST

[76] Inventor: Salvador Narvaez, 301 W. Saunders, Laredo, Tex. 78040

[21] Appl. No.: 355,496

[22] Filed: May 23, 1989

[51] Int. Cl.[5] ..... F41A 27/00

[52] U.S. Cl. ..... 42/94

[58] Field of Search ..... 42/94; 89/37.03, 37.04; 248/530, 532, 145, 156, 161, 407, 408

[56] References Cited

U.S. PATENT DOCUMENTS

| | | | |
|---|---|---|---|
| 879,052 | 2/1908 | Jeranek | 42/94 |
| 1,233,638 | 7/1917 | Baerman | 42/94 |
| 1,890,423 | 12/1932 | Teagarden | 42/94 |
| 2,121,982 | 6/1938 | Pugsley | 89/37.04 |
| 2,228,179 | 1/1941 | Motley | 89/37.03 |
| 2,847,909 | 8/1958 | Kester | 42/94 |
| 2,870,683 | 1/1959 | Wilson | 42/94 |
| 3,007,581 | 11/1961 | Moore | 42/94 |
| 3,125,929 | 3/1964 | Peasley | 42/94 |
| 3,225,656 | 12/1965 | Flaherty et al. | 42/94 |
| 3,827,172 | 8/1974 | Howe | 42/94 |
| 4,007,554 | 2/1977 | Helmstadtor | 42/94 |
| 4,506,466 | 3/1985 | Hall | 42/94 |
| 4,535,559 | 8/1985 | Hall | 42/94 |
| 4,565,403 | 1/1986 | Brown | 42/94 |

*Primary Examiner*—Charles T. Jordan

*Attorney, Agent, or Firm*—Fleit, Jacobson, Cohn, Price, Holman & Stern

[57] ABSTRACT

Upright standard structure is provided defining a longitudinal center axis and including upper and lower portions. The lower portion includes support structure for support of the standard structure from a support therebelow and angular displacement of the standard structure about its longitudinal center axis relative to the support structure. The upper portion of the standard structure includes a pair of upwardly facing support members mounted therefrom and disposed on opposite sides of the aforementioned center axis with the support members being horizontally aligned to support longitudinally spaced portions of a long gun therefrom. The support members are mounted from the upper portion of the standard structure for inverse elevational shifting relative to the standard structure, whereby the muzzle end of a long gun supported from the support members may be depressed and elevated, as desired, as well as angularly displaced about the aforementioned center axis.

18 Claims, 2 Drawing Sheets

ADJUSTABLE GUN REST

BACKGROUND OF THE INVENTION

1. Field of the Invention

A gun rest is provided including horizontally spaced apart upwardly facing support members for engaging and supporting longitudinally spaced portions of a long gun and the support members are mounted from an upper portion of an upright standard for inverse vertical movement, the standard lower portion being engageable with a support structure for angular displacement of the standard means about its longitudinal axis relative to the support structure. Two separate forms of the invention are disclosed and each form may have a longitudinal mid-portion of the standard thereof journalled from an upright sleeve carried by the forward end of a horizontal arm rest portion of a chair. Further, one of the two forms of the invention includes a standard incorporating a lower end invertible ground spike whereby the standard of the last mentioned form of the invention also may be utilized as a monopod, the ground spike being invertible and adapted to have a cushioned foot removably supported from the lower end thereof.

2. Description of Related Art

Various different forms of long gun rests heretofore have been provided such as those disclosed in U.S. Pat. Nos. 2,121,982, 2,847,909, 3,125,929, 4,506,466, 4,565,403 and 4,535,559. However, these previously known forms of long gun rests do not include the overall combination of structural features of the instant invention included in the instant invention.

SUMMARY OF THE INVENTION

The adjustable gun rest of the instant invention has been designed to provide a rest which may be adjusted to accommodate various long guns and which may be utilized to support various long guns for angular displacement about an upstanding axis and for inverse vertical shifting of the stock and muzzle ends of the supported long gun. In this manner, a reasonably steady rest is provided for an associated long gun to facilitate accuracy when firing the associated long gun.

A first form of gun rest is designed specifically to be used in conjunction with a chair-type support for a person handling and firing an associated long gun and a second disclosed form of the invention is designed to be used as a monopod-type of gun rest, but also may be used in conjunction with a chair-type support.

The main object of this invention is to provide a long gun rest which may be adjusted to accommodate and support long guns of different types.

Another object of this invention is to provide a long gun rest which will be operative to support an associated long gun for angular displacement about an upstanding axis.

Yet another object of this invention is to provide a long gun support in accordance with the preceding objects and which also will support an associated long gun for inverse vertical adjustment of the stock and muzzle ends of an associated long gun.

Another very important object of this invention is to provide a long gun rest which may be supported from a forward armrest portion of a chair-type support for a person handling and firing an associated long gun.

A further object of this invention is to provide a long gun support which may be used to support an associated long gun and which will function in the manner of a monopod-type support.

A final object of this invention to be specifically enumerated herein is to provide a long gun support in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
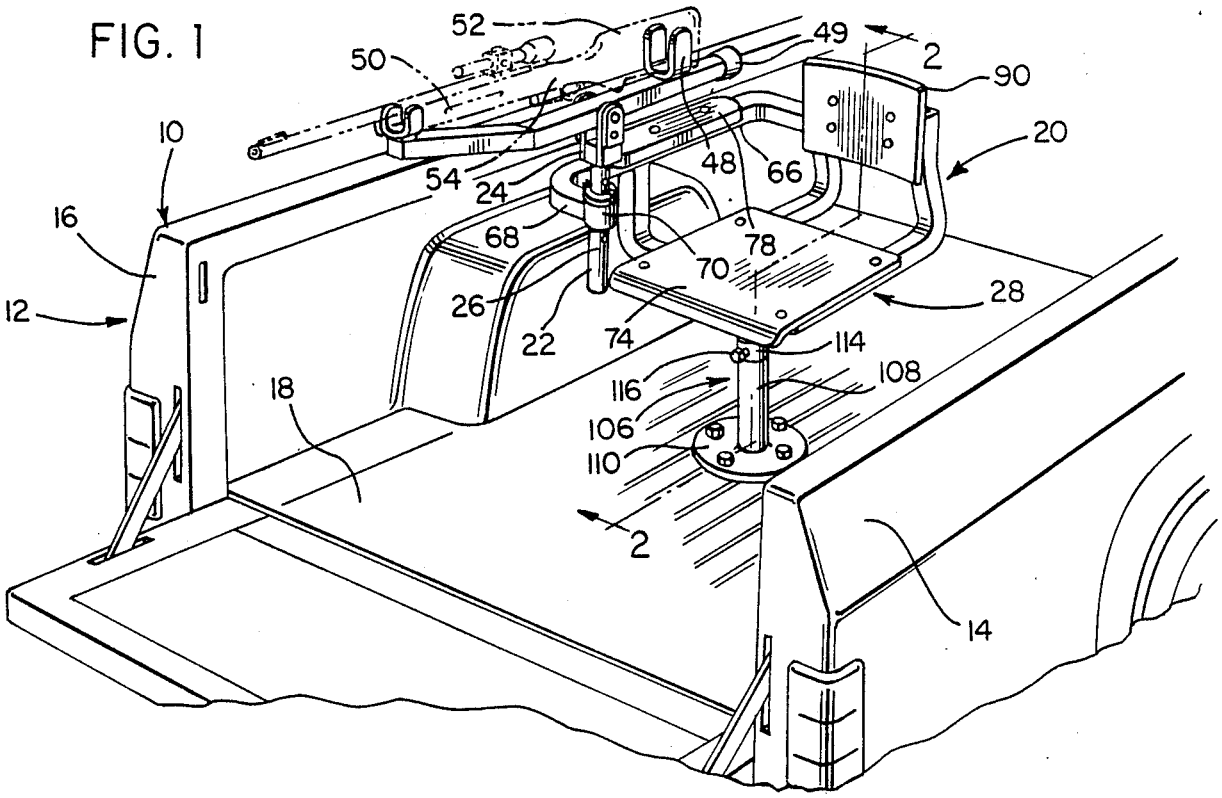
FIG. 1 is a perspective view of a first form of adjustable gun rest constructed in accordance with the present invention and mounted in the rear of a pickup truck.
Figure 2:
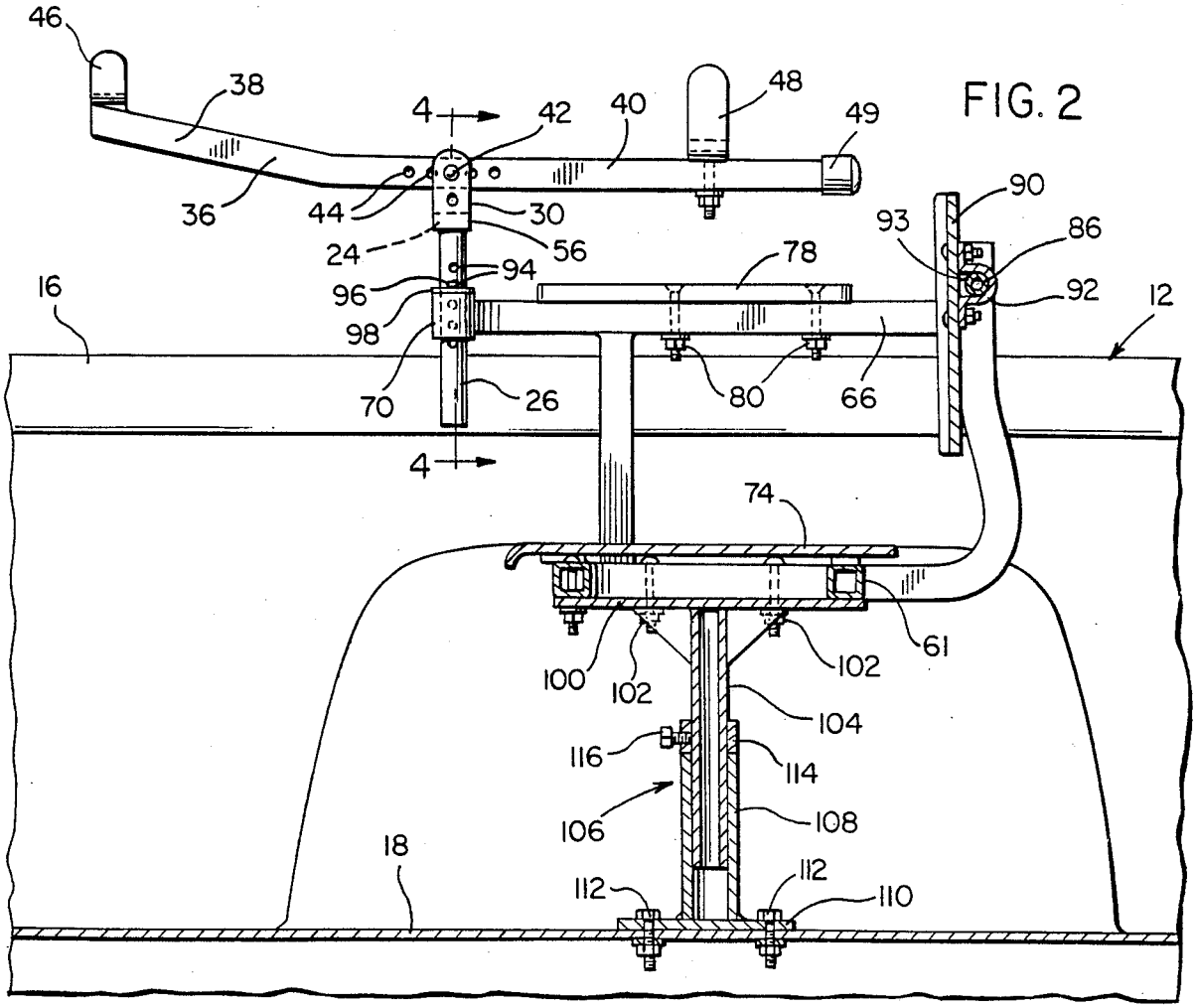
FIG. 2 is an enlarged vertical sectional view taken substantially upon the plane indicated by the section line 2—2 of FIG. 1.
Figure 3:
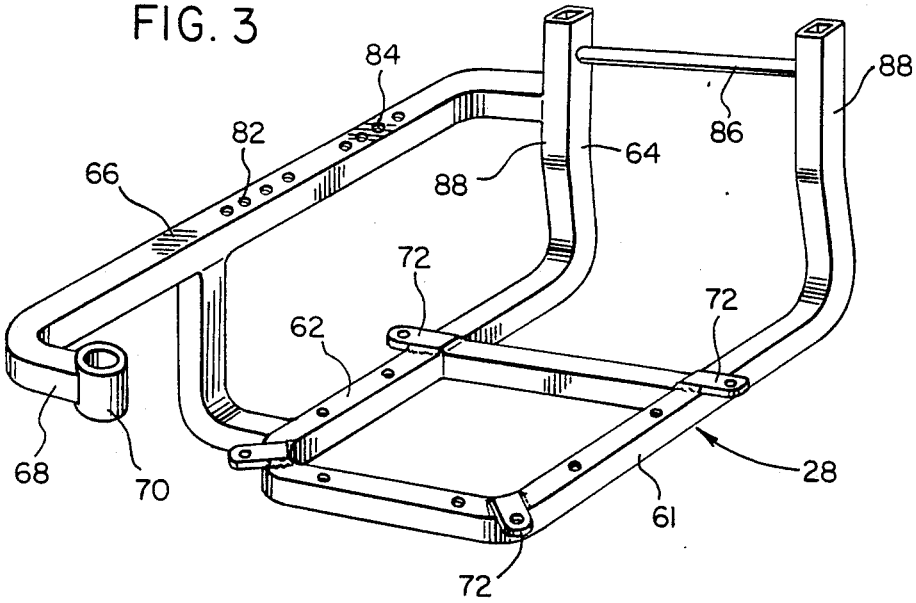
FIG. 3 is an enlarged perspective view of the chair frame and armrest unit of the invention illustrated in FIGS. 1 and 2.
Figure 4:
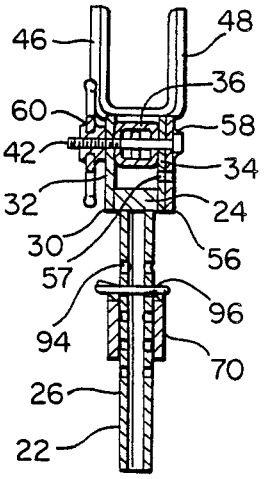
FIG. 4 is an enlarged vertical sectional view taken substantially upon the plane indicated by the section line 4—4 of FIG. 2.

Referring now more specifically to the drawings, the numeral 10 generally designates a pickup truck including a rear loadbed referred to in general by the reference numeral 12 and incorporating opposite sides 14 and 16 and a floor 18.

A first form of adjustable gun rest constructed in accordance with the present invention is referred to in general by the reference numeral 20 and mounted within the loadbed 12 from the floor 18. The gun rest 20 includes elongated upright standard structure 22 defining a longitudinal center axis and including upper and lower portions 24 and 26, respectively. The lower portion includes support structure referred to in general by the reference numeral 28 for support of the standard structure 22 from a support comprising the flooring 18.

The upper portion 24 includes an upwardly opening bifurcated mount 30 between whose furcations 32 and 34 an elongated support arm 36 incorporating front and rear ends 38 and 40 is pivotally mounted through the utilization of a transverse pivot bolt and wing nut assembly 42 extending through the furcations 32 and 34 and transversely through the support arm 36, the longitudinal mid-portion of the support arm 36 being provided with transverse bores 44 spaced longitudinally therealong through which the transverse pivot bolt and wing nut assembly 42 may be selectively received. The front and rear ends 38 and 40 of the support arm 36 include upwardly facing support members in the form of upwardly opening U-shaped cradles 46 and 48 welded thereto and the rear end 40 extends generally four inches rearward of cradle 48 and is resiliently capped as at 49. The cradles 46 and 48 are adapted to embracingly engage and support the foregrip and rear stock portions 50 and 52 of a long gun 54.

A retaining plate 56 removably overlies the outer surface of the furcation 34 and includes an inwardly projecting pin 57 engageable through a bore provided therefor in the furcation 34, the retaining plate 56 having the head end of the transverse pivot bolt and wing nut assembly 42 secured therethrough by welding 58 and the wing nut portion 60 of the assembly 42 is threadedly mounted on the end of the assembly 42 remote from the retaining plate 56.

The support structure 28 includes a chair frame referred to in general by the reference numeral 61 including integral seat and backrest portions 62 and 64 as well as a front-to-rear extending armrest portion 66 spaced above and outward of the right marginal portion of the chair frame 61. Of course, the armrest portion 66 could be similarly mounted from the left margin of the chair frame 61. Further, the armrest portion 66 is supported both from the seat portion 62 and the backrest portion 64 and includes an inwardly directed forward end terminal portion 68 provided with a vertical support sleeve 70.

The seat portion 62 includes front and rear pairs of opposite side mounting tabs 72 from which a seat panel 74 is mounted and an armrest element 78 is mounted from the armrest portion 66 through the utilization of suitable fasteners 80, the fasteners 80 being passed through front and rear sets of longitudinally spaced bores 82 and 84 formed in the armrest portion 66 whereby the armrest element 78 may be adjusted longitudinally along the armrest portion 66.

The backrest portion 64 includes a horizontal brace 86 extending between opposite side upright members 88 of the backrest portion 64 and a backrest panel 90 is supported from the horizontal brace 86 through the utilization of a horizontal forwardly opening channel member 92, a resilient filler 93 being interposed between the brace 86 and the rear surface of the panel 90 within the channel member 92.

The standard structure lower portion 26 comprises a cylindrical tubular member removably and rotatably downwardly telescopically received in the sleeve 70 and the lower portion 26 includes vertically spaced diametric bores 94. A removable pin 96 is secured through one of the bores 94 above the sleeve 70 and an abutment washer 98 is loosely disposed on the lower portion 26 below the pin 96 and above the sleeve 70 whereby the height of the lower portion 26 relative to the sleeve 70 is determined.

By mounting the standard structure 22 from the sleeve 70 in this manner and the support arm 36 from the upper portion 24 of the standard structure 22 as previously described, the long gun 54 may be angularly displaced about the longitudinal center axis of the standard structure 22 relative to the support structure 28 and the cradles 46 and 48 which support the front and rear stock portions 50 and 52 of the long gun 54 may be inversely varied in elevation. Thus, a person disposed on the support structure 28 is afforded an extremely steady support for his or her long gun 54 and may readily and accurately "sight in" on a target.

The underside of the chair frame 61 has a mounting plate 100 reversely and removably mounted therefrom through the utilization of removable fasteners 102. A central area of the mounting plate 100 fixedly supports the upper end portion 104 of a pedestal assembly 106 therefrom, the pedestal assembly 106 including a tubular lower end portion 108 into whose upper end the lower end of the upper end portion 104 is rotatably and telescopically received. The lower end of the lower end portion 108 includes a mounting flange 110 by which the pedestal assembly 106 is stationarily mounted from the flooring 18 through the utilization of suitable fasteners 112 and a stop collar 114 is removably fixed in adjusted position on the upper end portion 104 through the utilization of a set screw 116 and thereby adjusts the upper extension of the upper end portion 104 relative to the lower end portion 108 while still allowing the upper end portion 104 to rotate relative to the lower end portion 108.

It will be noted that the upper end portion 104 of the pedestal assembly 106 is slightly forwardly displaced relative to the mid-point between the fasteners 102. Accordingly, if the fasteners 102 are removed and the mounting plate 100 is reversed in position relative to the seat frame 61, the center axis of the pedal assembly 108 may be shifted rearwardly relative to the seat frame 61. Also, such modified positioning of the upper end portion 104 of the pedestal assembly 106 is beneficial when the upper end portion 104 is used to support the chair frame 61 from a chair base (not shown) rather than the lower end portion 108 of the pedestal assembly 106.

Figure 5:
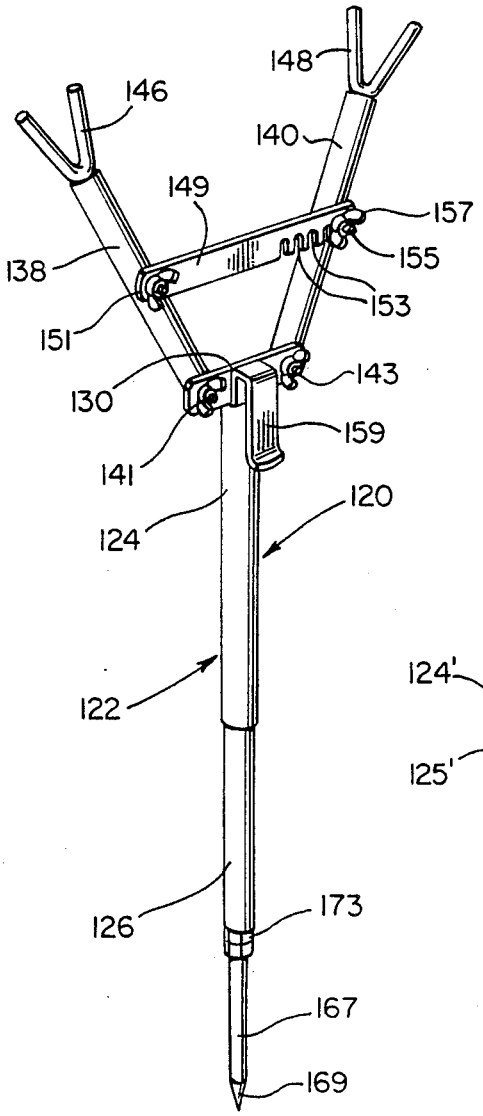
FIG. 5 is a perspective view of a second form of adjustable gun rest constructed in accordance with the present invention and which may be used as a monopod-type of support, or in conjunction with the chair or seat structure of the first form of the invention illustrated in FIGS. 1 and 2.
Figure 6:
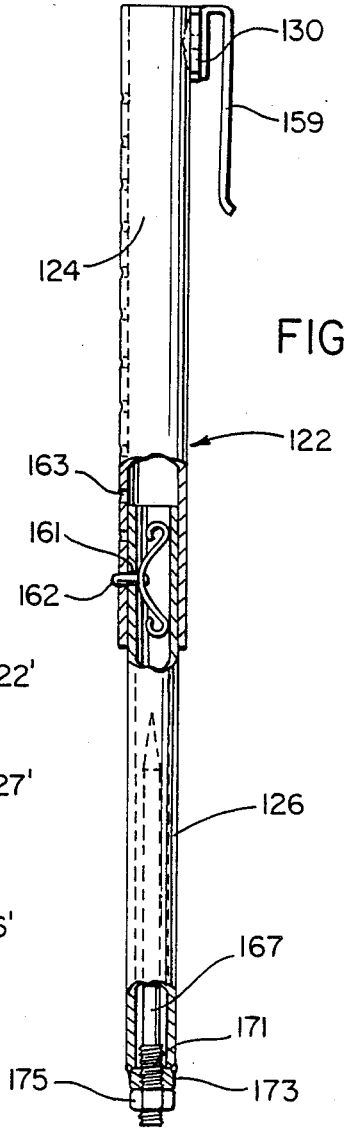
FIG. 6 is an enlarged elevational view of the lower standard structure portion of the second form of gun rest as seen from the left side of FIG. 5 and with portions of the standard structure broken away and illustrated in vertical section and the lower terminal end ground spike inverted and mounted in stored position within the lower end of the standard structure.

With reference now more specifically to FIGS. 5 and 6 of the drawings, there may be seen a modified form of gun rest referred to in general by the reference numeral 120. The gun rest 120 includes standard structure 122 corresponding to the standard structure 22. The standard structure 122 includes upper and lower portions 124 and 126 and the upper portion 124 includes a mount 130 supported therefrom in any convenient manner such as by welding. A pair of upstanding front and rear arms 138 and 140 have their lower ends pivotally supported from the mount 130 through the utilization of pivot fasteners 141 and 143 and the upper ends of the arms 138 and 140 support upwardly opening cradles 146 and 148 therefrom corresponding to the cradles 46 and 48. Further, an elongated connecting link 149 is provided and has one end thereof pivotally supported from the arm 138 as at 151 and the other end of the link 149 is provided with longitudinally spaced downwardly opening notches 153 engageable over a threaded stud 155 carried by and projecting outwardly of the arm 140, a threaded wing nut 157 being provided for loose tightening on the stud 155. This arrangement allows the arms 138 and 140 to be interconnected by an adjustable length link and yet still allow the arms 138 and 140 to pivot relative to the mount 130. Accordingly, the cradles 146 and 148 are also mounted from the standard structure 122 for inverse vertical movement whereby the muzzle and butt ends of the long gun 54 may be supported for inverse vertical shifting.

The mount 130 supports a downwardly opening belt hook 159 therefrom whereby the gun rest 120 may be supported from a hunter's belt and the upper end of the lower portion 126 is provided with a radial bore 161 through which a spring biased and retractable pin 162 projects and vertically spaced radial bores 163 are formed in the upper portion 124 with which the pin 162 is selectively registrable for reception therein to retain the upper and lower portions 124 and 126 of the standard structure 122 in adjusted relatively extended positions.

It will be noted that the outside diameter of the lower portion 126 is substantially identical to the outside diameter of the lower portion 26 and, accordingly, that the gun rest 120 may be supported from the sleeve 70 of the support structure 28.

Attention is now invited to the lower end of the lower portion 126 illustrated in FIGS. 5 and 6. From FIG. 5 it may be seen that a ground spike 167 is provided including a pointed lower terminal end 169 and a slightly enlarged and externally threaded upper end 171. The upper end 171, in FIG. 5, is threaded into a threaded nut 173 secured to the lower end of the tubular lower portion 126 and a nut 175 is fixed in position on the upper end 171 and jammed against the nut 173. However, as shown in FIG. 6, the ground spike 167 may be removed, inverted and telescoped upwardly into the lower portion 126 and secured therein by again jamming the nut 175 against the nut 173, the exposed terminal end of the upper end 171 then being available to have an enlarged resilient foot (not shown) removably threaded thereon, if desired.

It will be noted that the pivot fasteners 141 and 143 are spaced outward of opposite sides of the upper portion 124. Thus, the wing nut 157 may be loosened, the notched end of the link 149 may be disengaged from the stud 155 and the arms 138 and 140 may be swung outwardly and downwardly toward positions closely opposing opposite sides of the upper portion 124. In this manner, the gun rest 120 may be transformed into a relatively compact article for storage and transit.

Figure 7:
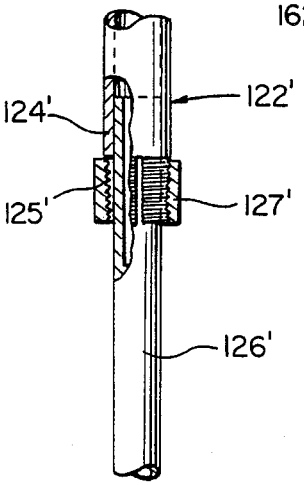
FIG. 7 is an enlarged elevational view similar to the vertical central portion of FIG. 6, but illustrating a slightly modified form of lower standard structure portion.

Referring now to FIG. 7, the numeral 122' designates a standard structure similar to standard structure 122, but wherein the lower end of the upper portion 124' thereof defines an externally threaded split collet 125' for clamping engagement upon the lower portion 126' thereof through the use of a tapered threaded nut 127'.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A gun rest for a long gun, said gun rest including elongated upright standard means defining a longitudinal center axis and including upper and lower portions, said lower portion including support structure for support of said standard means from a support therebelow and angular displacement of said standard means about said center axis relative to said support structure, the upper portion of said standard means including a pair of upwardly facing support members mounted therefrom and disposed on opposite sides of said center axis with said support members being horizontally aligned to support therefrom longitudinally spaced portions of a long gun, said support members being mounted from said upper portion for inverse elevational shifting relative to said standard means, whereby the muzzle end of a long gun supported from said support members may be depressed and elevated, as desired, and also angularly displaced about said center axis, said lower portion of said standard means defining a cylindrical shank including vertically adjustable, downwardly facing stop surface means, a support, said support including a seat for supporting a seated person thereon, said seat including an elevated front-to-rear extending armrest on one side thereof, a forward portion of said armrest including upstanding support sleeve means mounted therefrom, said shank being rotatably received through said sleeve means with said stop surface means abutting said sleeve means from above.

2. The gun rest of claim 1 including a generally horizontal support arm, means mounting a longitudinal central portion of said support arm from said upper portion of said standard means for angular displacement of said support arm relative to said standard means upper portion about a horizontal axis extending transversely of said support arm, said support members being carried by opposite end portions of said support arm.

3. The gun rest of claim 2 wherein said mounting means includes means operative to laterally shift said horizontal axis longitudinally of said support arm.

4. The gun rest of claim 1 including an armrest element, mounting structure mounting said armrest element over said armrest in selected adjusted positions spaced longitudinally of said rest.

5. The gun rest of claim 1 wherein said seat includes a depending adjustable length pedestal, the lower end of said pedestal including base means for support from a support structure.

6. The gun rest of claim 5 wherein said seat and pedestal include adjustment means mounting said seat from said pedestal for selective shifting of said pedestal in a front-to-rear direction relative to said seat.

7. The gun rest of claim 1 wherein said lower portion of said standard means includes upper and lower end portions, said lower end portion being extendable and retractable relative to said upper end portion, and securing means operative to releasably secure said lower end portion in selected extended position relative to said upper end portion.

8. The gun rest of claim 7 wherein at least the lower extremity of said lower end portion is tubular, a ground spike including an upper terminal end removably secured in said lower extremity and a tapered lower terminal end.

9. The gun rest of claim 9 wherein said ground spike is invertible and upwardly telescopically receivable in said lower extremity with said upper terminal end removably secured in said lower extremity.

10. The gun rest of claim 1 wherein said upper portion of said standard means includes a mount supported therefrom, a pair of upwardly divergent arms having their lower ends mounted from said mount for angular displacement relative to said mount about horizontal axes disposed transverse to said arms, said support members being carried by the upper ends of said arms, and elongated connecting link means extending and pivotally connected between vertical mid-portions of said arms.

11. The gun rest of claim 10 wherein said connecting link means and at least one of said arms includes coacting means operative to adjust the effective length of said connecting link means.

12. The gun rest of claim 11 wherein said coacting means defines a releasable pivot connection between said connecting link means and said one arm.

13. The gun rest of claim 10 wherein said mount includes a downwardly opening belt engageable hook.

14. The gun rest of claim 1 wherein said lower portion of said standard means includes upper and lower end portions, said lower end portion being extendable and retractable relative to said upper end portion, and securing means operative to releasably secure said lower end portion in selected extended position relative to said upper end portion, said securing means including a radial pin and bore connection between said upper and lower end portions.

15. The gun rest of claim 1 wherein said lower portion of said standard means includes upper and lower end portions, said lower end portion being extendable and retractable relative to said upper end portion, and securing means operative to releasably secure said lower end portion in selected extended position relative to said upper end portion, said securing means including a releasable split collet connection between said upper and lower end portions.

16. A gun rest for a long gun, said gun rest including elongated upright standard means defining a longitudinal center axis and including upper and lower portions, said lower portion including support structure for support of said standard means from a support therebelow and angular displacement of said standard means about said center axis relative to said support structure, the upper portion of said standard means including a pair of upwardly facing support members mounted therefrom and disposed on opposite sides of said center axis with said support members being horizontally aligned to support therefrom longitudinally spaced portions of a long gun, said support members being mounted from said upper portion for inverse elevational shifting relative to said standard means, whereby the muzzle end of a long gun supported from said support members may be depressed and elevated, as desired, and also angularly displaced about said center axis, said upper portion of said standard means including a mount supported therefrom, a pair of upwardly divergent arms having their lower ends mounted from said mount for angular displacement relative to said mount about horizontal axes disposed transverse to said arms and standard means, said support members being carried by the upper ends of said arms, and elongated connecting link means extending and pivotally connected between said arms intermediate the upper and lower ends thereof, whereby the upper ends of said arms may be swung in unison about their respective axes of angular displacement and said support members may be inversely elevated and lowered relative to said axes responsive to swinging movement of said arms, in unison, about said axes.

17. The gun rest of claim 16 wherein said connecting link means and at least one of said arms includes coacting means operative to adjust the effective length of said connecting link means.

18. The gun rest of claim 17 wherein said lower portion of said standard means includes upper and lower end portions, said lower end portion being extendable and retractable relative to said upper end portion, and securing means operative to releasably secure said lower end portion in selected extended position relative to said upper end portion.

* * * * *